US010974379B2

(12) United States Patent
Piras

(10) Patent No.: US 10,974,379 B2
(45) Date of Patent: Apr. 13, 2021

(54) ROCK BREAKING DEVICE

(71) Applicant: Montabert, Saint Priest (FR)

(72) Inventor: Bernard Piras, Vernaison (FR)

(73) Assignee: Montabert, Saint Priest (FR)

( * ) Notice: Subject to any disclaimer, the term of this patent is extended or adjusted under 35 U.S.C. 154(b) by 120 days.

(21) Appl. No.: 15/778,884

(22) PCT Filed: Nov. 30, 2016

(86) PCT No.: PCT/EP2016/079349
§ 371 (c)(1),
(2) Date: May 24, 2018

(87) PCT Pub. No.: WO2017/093361
PCT Pub. Date: Jun. 8, 2017

(65) Prior Publication Data

US 2018/0345470 A1 Dec. 6, 2018

(30) Foreign Application Priority Data

Dec. 2, 2015 (FR) ..... 1561749

(51) Int. Cl.
*B25D 17/24* (2006.01)
*B25D 9/12* (2006.01)
(Continued)

(52) U.S. Cl.
CPC ..... *B25D 17/245* (2013.01); *B25D 9/12* (2013.01); *B25D 9/18* (2013.01); *B25D 9/26* (2013.01);
(Continued)

(58) Field of Classification Search
CPC . B25D 9/26; B25D 9/145; B25D 9/16; B25D 9/18; B25D 9/20; B25D 9/22;
(Continued)

(56) References Cited

U.S. PATENT DOCUMENTS 1,846,804 A 2/1932 Hansen
3,411,592 A * 11/1968 Montabert ..... B25D 9/20 173/207
(Continued)

FOREIGN PATENT DOCUMENTS

| | | | |
|---|---|---|---|
| EP | 2032316 | A2 | 3/2009 |
| FR | 2369908 | A1 | 6/1978 |
| FR | 2916377 | A1 | 11/2008 |
| GB | 2074925 | A | 11/1981 |
| WO | WO-2008149030 | A2 | 12/2008 |
| WO | WO-2011059217 | A2 | 5/2011 |

OTHER PUBLICATIONS

ISA/EPO International Search Report for Corresponding International Application No. PCT/EP2016/079349, dated Feb. 23, 2017 (8 pgs).

*Primary Examiner* — Valentin Neacsu
(74) *Attorney, Agent, or Firm* — Harris Beach PLLC

(57) ABSTRACT

The invention concerns a rock breaking device comprising a striking cell having at least one actuation chamber, a striking piston, and a hydraulic circuit comprising a hydraulic supply source having a High Pressure circuit and a Low Pressure circuit, and an actuator configured to connect the High Pressure circuit or the Low Pressure circuit to the actuation chamber so as to move the piston in translation in the striking cell in a normal movement area of which the limits are variable depending on the pressure difference between the High Pressure circuit and the Low Pressure circuit, the striking cell comprising depressurizing means configured to control the establishment of hydraulic communication between the High Pressure circuit and the Low Pressure circuit when the striking piston exits a predefined movement area.

11 Claims, 7 Drawing Sheets

(51) Int. Cl.
*B25D 9/18* (2006.01)
*B25D 9/26* (2006.01)

(52) U.S. Cl.
CPC ..... *B25D 2217/0023* (2013.01); *B25D 2250/195* (2013.01)

(58) Field of Classification Search
CPC ... B25D 9/24; B25D 9/12; B25D 9/14; B25D 9/265; B25D 9/04; B25D 9/125; B25D 17/245; F15B 11/0423; F15B 11/0445; F15B 11/044; F15B 11/046; F15B 11/055
USPC ..... 173/200, 207; 91/321, 277, 278, 303, 91/300
See application file for complete search history.

(56) References Cited

U.S. PATENT DOCUMENTS

| | | | | |
|---|---|---|---|---|
| 4,109,734 | A | 8/1978 | Montabert et al. | |
| 7,779,930 | B2 * | 8/2010 | Lohmann ..... | B25D 9/265 173/115 |
| 8,151,900 | B2 * | 4/2012 | Piras ..... | B25D 9/145 173/13 |
| 2008/0296035 | A1 * | 12/2008 | Lohmann ..... | B25D 9/265 173/177 |
| 2009/0250234 | A1 * | 10/2009 | Piras ..... | B25D 9/145 173/207 |
| 2010/0084152 | A1 * | 4/2010 | Piras ..... | B25D 9/12 173/206 |

* cited by examiner

State of the art

State of the art

ROCK BREAKING DEVICE

CROSS-REFERENCE TO RELATED APPLICATIONS

This application is a national stage application under 35 U.S.C. § 371 of PCT Application No. PCT/EP2016/079349, filed on Nov. 30, 2016, which claims priority to and the benefit of French Application No. 1561749 filed on Dec. 2, 2015, which are incorporated herein by reference in their entirety.

TECHNICAL FIELD

The present invention relates to the domain of construction machinery. It concerns a hydraulic percussion device of the "rock breaker" or similar type.

PRIOR ART

As described in FIGS. 1 and 2 illustrating the state of the art, hydraulic percussion devices 100 called "rock breakers" are generally made up of a body containing a power cell 120 protected from the outside environment by a mechanically welded structure that also makes it possible to fasten the power cell 120 to a carrier machine 11.

The power cell 120 comprises a greased mechanical front part that bears a tool 250 intended to come into contact with a rock to be broken. The tool 250 is guided by wearing rings, retained in translation in one direction by a system of keys and in the other by a press-fitting stop 300 that makes it possible to transmit the impact from the carrier machine 11. A central part of the power cell 120 comprises an impact piston 160 translatable within a cylinder in such a way as to strike the tool 250. A third part of the power cell 120 can be situated laterally or above the cylinder and comprises a hydraulic circuit providing a cadenced alternating movement of the impact piston 160.

The movements of the impact piston 160 are actuated by two opposing annular chambers 140, 150 supplied alternately by fluid under pressure. The power cell 120 also comprises a compression chamber 290, containing a compressible gas, arranged above the impact piston 160. When the device 100 is actuated, a first phase consists in moving the impact piston 160 within the compression chamber 290 by means of the application of pressure within the lower annular chamber 150, thus compressing the gas within the compression chamber 290.

A second phase consists in canceling the effect of the pressure within the lower annular chamber 150, by supplying the upper annular chamber 140 with substantially the same pressure. The force complementary to that created by the compressible gas then applied to the impact piston 160 depends upon the difference in surface area between the annular chambers 140, 150 and this difference in surface area is generally small. In a third phase, the compressible gas is expanded, and it violently moves the impact piston 160 downwards, impacting the tool 250 with sufficient force to break a rock.

The annular chambers 140, 150 are supplied by a High-Pressure circuit 170 and a Low-Pressure circuit 180. Preferably, the High-Pressure circuit 170 is connected to a hydraulic pump and the Low-Pressure circuit 180 is connected to an open reservoir of the carrier machine 11. The upper annular chamber 140 is connected either to the High-Pressure circuit 170 or to the Low-Pressure circuit 180 by means of an actuator 200, for example a distributor. The position of the actuator 200 is actuated by the position of the impact piston 160. To that end, the impact piston 160 comprises an actuating chamber 280 able to be connected on the one hand to the Low-Pressure circuit 180 and on the other hand to the actuation circuit 210 of the actuator 200. The actuation circuit 210 of the actuator 200 comprises a channel emerging into the lower annular chamber 150 when the impact piston 160 rises. The lower annular chamber 150 being connected with the High-Pressure circuit 170 of the hydraulic circuit, the actuation circuit 210 is thus connected to the High-Pressure circuit 170, which results in the operation of the actuator 200 such as to connect the upper annular chamber 140 with the High-Pressure circuit 170 of the hydraulic circuit. When the impact piston 160 descends, the actuating chamber 280 connects the actuation circuit 210 with the Low-Pressure circuit 180. The actuation circuit 210 is thus connected to the Low-Pressure circuit 180, which causes the slide-valve of the actuator 200 to move such as to connect the upper annular chamber 140 with the Low-Pressure circuit 180. The operation of the actuator 200 is performed hydraulically based upon the position of the impact piston 160.

However, when the pressure of the High-Pressure circuit 170 exceeds a threshold value, for example during an incorrect manipulation by an operator acting on the carrier machine 11, the speed of the impact piston 160 increases. The operation of the actuator 200 being performed based upon the position of the impact piston 160, the duration of the control cycles of the actuator 200 also decreases when the speed of the impact piston 160 increases, causing the speed of the impact piston 160 to run away. Furthermore, the travel of the impact piston 160 also increases in the compression chamber 290. Thus, an excess flow rate of the High-Pressure circuit 170 may cause an overspeed of the impact piston 160 with respect to an acceptable speed limit for the fatigue behavior and wear of the device 100. Furthermore, damage may also appear due to this overspeed.

To resolve this problem, it is known from American patent application no. US 2008/0296035, as shown in FIG. 2, to use a hydraulic fuse 110 positioned between the High-Pressure circuit 170 and the Low-Pressure circuit 180 such as to return part of the flow rate of the High-Pressure circuit 170 toward the Low-Pressure circuit 180 when the pressure of the High-Pressure circuit 170 exceeds a threshold value. However, this solution is complicated to incorporate into the body of the device.

International patent application no. WO 2008/149030 proposes an alternative solution consisting of deviating the excess flow rate directly to the reservoir of the carrier machine. However, this solution requires modifying the carrier machine.

French patent application no. FR 2,916,377 by the present Applicant proposes a solution consisting in measuring the flow rate at the High-Pressure circuit 170 and deviating the excess flow rate toward the Low-Pressure circuit 180 when the flow rate of the High-Pressure circuit 170 exceeds a predetermined value. The deviation of the flow rate is performed by a flow rate regulating device arranged within the power cell 120 at an upper end of the impact piston 160. However, this solution increases the radial bulk of the upper part of the power cell 120.

The increase in the bulk of the power cell 120 also increases the mounting and design complexity of the rock breaking device. Furthermore, this solution is not implemented for low-power devices, since the bulk of the solution for protecting against excess flow rates would be too great compared to the volume of the power cell 120.

The technical problem of the invention therefore consists in proposing a rock breaking device provided with protection against excess flow rates wherein the bulk is reduced.

DESCRIPTION OF THE INVENTION

The present invention proposes to resolve this problem using a rock breaking device provided with protection against excess flow rates, the control of which is performed based upon the travel of the piston.

To that end, the invention relates to a rock breaking device comprising a power cell having at least one actuating chamber, an impact piston translatable in the power cell, and a hydraulic circuit a hydraulic supply source having a High-Pressure circuit and a Low-Pressure circuit, and an actuator configured to connect the High-Pressure circuit or the Low-Pressure circuit to the actuating chamber in such a way as to translate the piston within the power cell within a normal movement zone, the boundaries of which are variable depending upon the pressure difference between the High-Pressure circuit and the Low-Pressure circuit. The power cell also comprises depressurization means configured to control the placing in hydraulic communication of the High-Pressure circuit with the Low-Pressure circuit when the power cell leaves a predetermined movement zone.

The invention thus makes it possible to use the increase in the normal travel of the impact piston when there are excess flow rates to control a transfer of flow rate from the High-Pressure circuit to the Low-Pressure circuit, thus making it possible to limit the bulk of the rock breaking device. Furthermore, the integration and mounting of the protection against excess flow rates with the existing elements is easier.

According to one embodiment, the depressurization means comprise:

a groove arranged on the impact piston, and a regulating portion connected on the one hand to the High-Pressure circuit and on the other hand to the Low-Pressure circuit, the regulating portion being closed off by the impact piston when the impact piston is movable in the predetermined movement zone, said groove being intended to penetrate the regulating portion when the impact piston leaves the predetermined movement zone so as to place the High-Pressure circuit in hydraulic communication with the Low-Pressure circuit through the regulating portion.

This embodiment is particularly easy to implement, since producing a groove in the impact piston is a traditional process.

According to one embodiment, the depressurization means comprise:

a depressurization valve connected on the one hand to the High-Pressure circuit and on the other hand to the Low-Pressure circuit, the depressurization valve being able to adopt two positions: a maintenance position wherein the High-Pressure circuit is disconnected from the Low-Pressure circuit, and a depressurization position wherein the High-Pressure circuit is connected to the Low-Pressure circuit, the position of said depressurization valve being controlled by a hydraulic circuit, a regulating portion connected on the one hand to the High-Pressure circuit and on the other hand to the hydraulic circuit, the regulating portion being closed off by the impact piston when the impact piston is movable in the predetermined movement zone such that the hydraulic circuit actuates the depressurization valve in the maintenance position, and a groove arranged on the impact piston, said groove being intended to penetrate the regulating portion when the impact piston leaves the predetermined movement zone such that the hydraulic circuit actuates the depressurization valve in the depressurization position.

This embodiment makes it possible to limit the flow rate within the groove, since the fluid that passes through the groove serves solely to actuate the depressurization valve.

According to one embodiment, the depressurization means comprise:

a groove and an annular protuberance that are arranged consecutively on the impact piston, and a regulating portion connected on the one hand to the Low-Pressure circuit and on the other hand to the actuating chamber, the annular protuberance closing off a hydraulic communication channel between the regulating portion and the actuating chamber when the impact piston is movable in the predetermined movement zone, said groove being intended to penetrate the actuating chamber when the impact piston leaves the predetermined movement zone such as to place the actuating chamber in hydraulic communication with the regulating portion through a channel passing through the groove.

This embodiment makes it possible to limit the bulk of the device by arranging the actuating chamber in hydraulic communication with the regulating portion.

According to one embodiment, the device comprising two actuating chambers, an upper actuating chamber and a lower actuating chamber, the regulating portion is positioned above the upper actuating chamber.

According to one embodiment, the device comprising two actuating chambers, an upper actuating chamber and a lower actuating chamber, the regulating portion is positioned below the upper actuating chamber.

According to one embodiment, the device comprising two actuating chambers, an upper actuating chamber and a lower actuating chamber, the regulating portion is positioned between the two actuating chambers.

According to one embodiment, the device comprises hydraulic braking means for the impact piston configured to slow the travel of the impact piston when the impact piston leaves the predetermined movement zone. This embodiment makes it possible to calibrate the quantity of fluid transmitted between the High-Pressure circuit and the Low-Pressure circuit when the impact piston leaves the predetermined movement zone.

According to one embodiment, the hydraulic braking means comprise a spray nozzle connected to the Low-Pressure circuit and configured to extract part of a hydraulic fluid contained in the hydraulic braking means. This embodiment also makes it possible to calibrate the quantity of fluid transmitted between the High-Pressure circuit and the Low-Pressure circuit when the impact piston leaves the predetermined movement zone.

According to one embodiment, the hydraulic braking means comprise:

a channel connecting the actuating chamber with the Low-Pressure circuit, an annular protuberance arranged on the impact piston, and a movable ring in the actuating chamber, the ring being positioned in order to close off the channel when the impact piston is movable in the predetermined movement zone, the annular protuberance being intended to penetrate the ring when the impact piston leaves the predetermined movement zone such as to create an emptying compartment wherein the pressure is sufficient to move the ring and establish hydraulic communication between the emptying compartment and the channel, the annular protuberance being removed from the ring and the ring being repositioned in order to close off the channel when the pressure difference between the actuating chamber and the emptying compartment is above a threshold value.

This embodiment makes it possible to provide braking of the impact piston in such a way as to calibrate the quantity of fluid transmitted between the High-Pressure circuit and the Low-Pressure circuit when the impact piston leaves the predetermined movement zone.

Furthermore, this embodiment limits the bulk of the braking system, since it is integrated into the actuating chamber.

According to one embodiment, the hydraulic braking means (35) comprise:

an annular protuberance arranged on the impact piston, and a movable ring in the actuating chamber, the annular protuberance being intended to penetrate the ring when the impact piston leaves the predetermined movement zone such as to create an emptying compartment wherein the pressure is sufficient to move the ring around the annular protuberance, the fluid contained in the emptying compartment being able to reach the actuating chamber by means of a peripheral channel arranged around the ring when the ring is moved on the annular protuberance such as to reduce the pressure difference between the emptying compartment and the actuating chamber and remove the annular protuberance from the ring.

This embodiment also makes it possible to provide braking of the impact piston in such a way as to calibrate the quantity of fluid transmitted between the High-Pressure circuit and the Low-Pressure circuit when the impact piston leaves the predetermined movement zone. Furthermore, this embodiment limits the bulk of the braking system, since it is integrated into the actuating chamber and does not have a channel connecting the actuating chamber with the Low-Pressure circuit.

BRIEF DESCRIPTION OF THE FIGURES

The method for implementing the invention and the advantages thereof will become more apparent from the following disclosure of the embodiments, given by way of a non-limiting examples, supported by the attached figures wherein

FIG. 1, state of the art: a perspective view of a carrier machine equipped with a rock breaking device;

FIG. 2, state of the art: a schematic representation in cross-section of the rock breaking device of FIG. 1;

FIG. 3: a schematic representation in cross-section of a rock breaking device according to a first embodiment of the invention;

FIG. 4: a schematic representation in cross-section of a rock breaking device according to a second embodiment of the invention;

FIG. 5: a schematic representation in cross-section of a rock breaking device according to a third embodiment of the invention;

FIG. 6: a schematic representation in cross-section of a rock breaking device according to a fourth embodiment of the invention;

FIG. 7: a schematic representation in cross-section of a rock breaking device according to a fifth embodiment of the invention;

FIG. 8: a schematic representation in cross-section of a rock breaking device according to a sixth embodiment of the invention;

FIGS. 9-11: a schematic representation in cross-section of a rock breaking device according to a seventh embodiment of the invention.

DETAILED DESCRIPTION OF THE INVENTION

Figure 1:
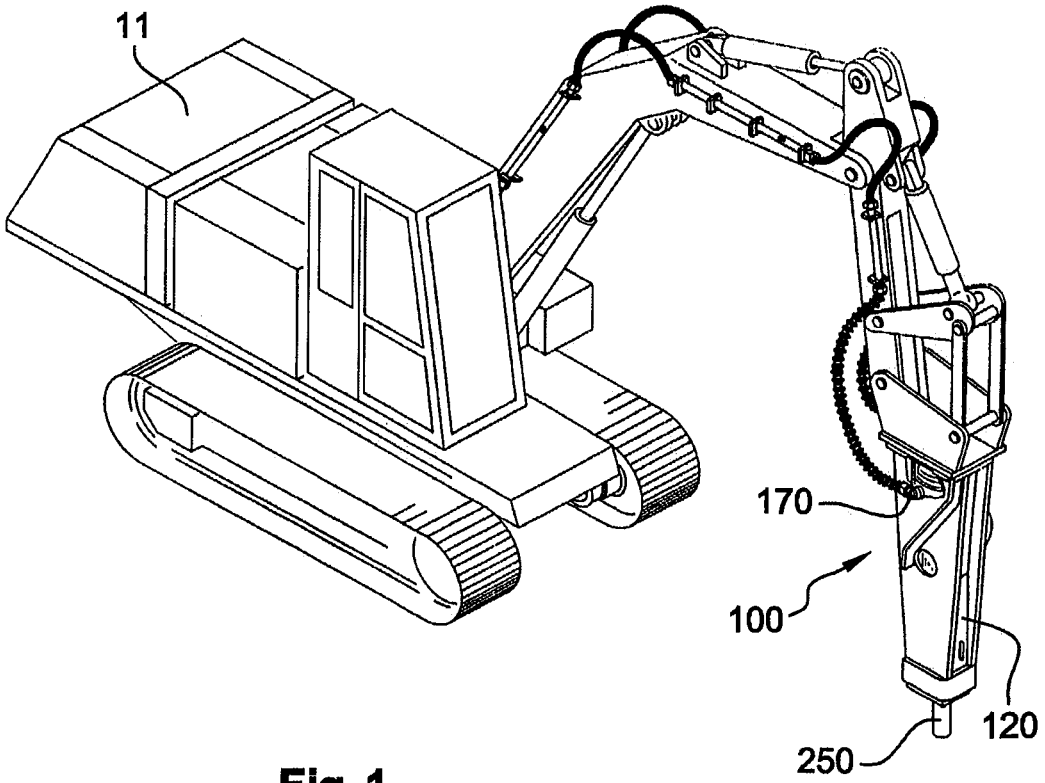
FIGS. 1 to 11 represent.
Figure 2:
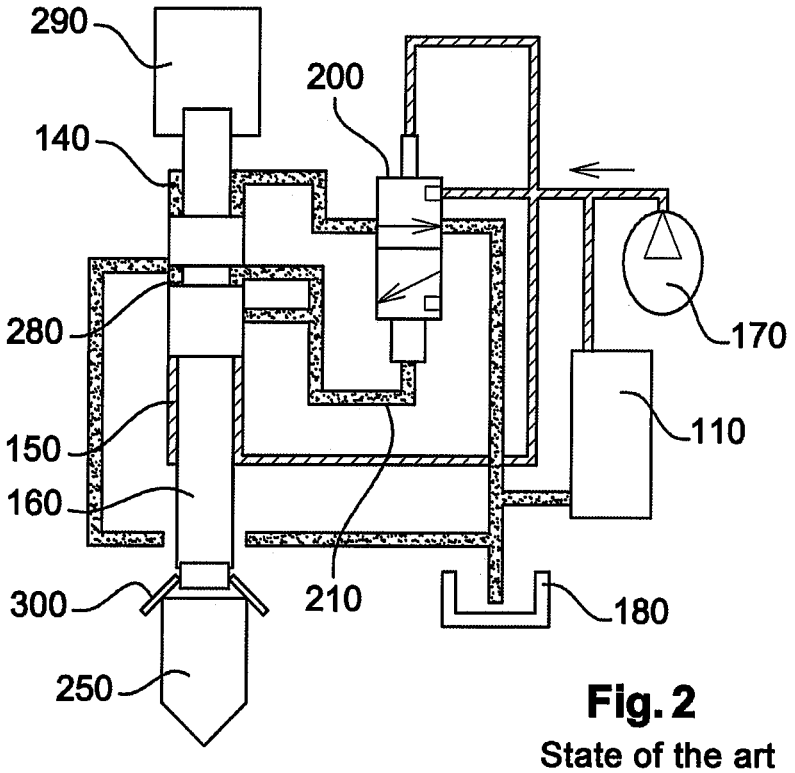

In the description, the hydraulic percussion device 10*a*-10*f* is described assuming that it is positioned in the most common configuration thereof, namely vertically, i.e., with the tool 25 oriented vertically, in contact with a surface to be demolished, as illustrated in FIG. 1.

Figure 3:
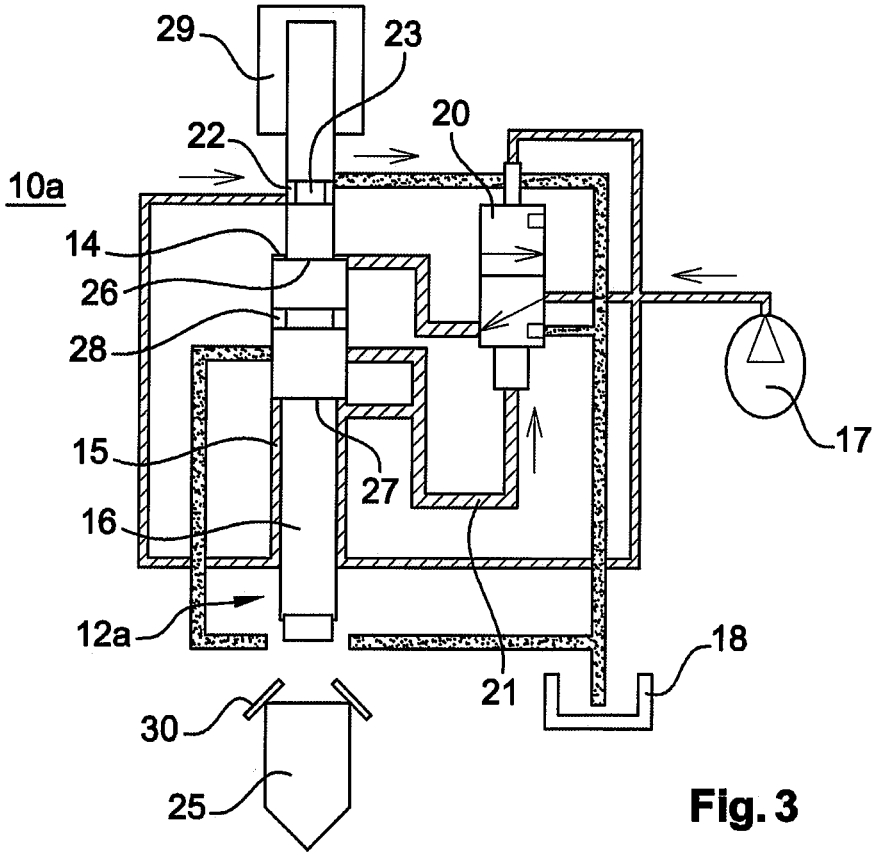

FIG. 3 illustrates a hydraulic percussion device 10*a* called "rock breaking device" intended to be mounted on a carrier machine 11 as illustrated in FIG. 1. The rock breaking device 10*a* comprises a power cell 12*a* protected from the outside environment by a mechanically welded structure, not shown, which also makes it possible to fasten the power cell 12*a* to the carrier machine 11.

The power cell 12*a* comprises a greased mechanical front part that carries a tool intended to come into contact with a rock to be broken.

The tool 25 is guided by wearing rings, retained in translation in one direction by a system of keys and in the other by a fitting stop 30 that makes it possible to transmit the impact from the carrier machine 11. A central part of the power cell 12*a* comprises an impact piston 16 translatable in the power cell 12*a* such as to strike the tool 25. A third part of the power cell 12*a* can be situated laterally or above the impact piston 16 and comprises a hydraulic circuit providing a cadenced alternating movement of the impact piston 16.

The movements of the impact piston 16 are controlled by two opposing chambers 14, 15 supplied alternately by fluid under pressure. To that end, the impact piston 16 comprises an upper shoulder 26 upon which a fluid contained in the upper chamber 14 can bear in order to move the impact piston 16 downward and a lower shoulder 27 on which a fluid contained in the lower chamber 15 can bear in order to move the impact piston 16 upward. The power cell 12*a* also comprises a compression chamber 29, containing a compressible gas, arranged above the impact piston 16. When the device 10*a* is actuated, a first phase consists in moving the impact piston 16 in the compression chamber 29 by application of a pressure in the lower chamber 15, thus compressing the gas in the compression chamber 29. A second phase consists in canceling the effect of the pressure in the lower chamber 15, by supplying the upper chamber 14 with substantially the same pressure. The force then applied to the impact piston 16 depends upon the difference in surface area between the shoulders 26, 27. This difference in surface area is generally small. In a third phase, the compressible gas is expanded, and it violently moves the impact piston 16 downwards, impacting the tool 25 with sufficient force to break a rock.

The chambers 14, 15 are supplied by a High-Pressure circuit 17 and a Low-Pressure circuit 18. Preferably, the High-Pressure circuit 17 is connected to a hydraulic pump and the Low-Pressure circuit 18 is connected to an open reservoir of the carrier machine 11. The upper chamber 14 is connected either to the High-Pressure circuit 17 or to the Low-Pressure circuit 18 by means of an actuator 20, for example a distributor. The position of the actuator 20 is controlled by the position of the impact piston 16.

To that end, the impact piston 16 comprises an actuating chamber 28 able to be connected on the one hand to the Low-Pressure circuit 18 and on the other hand to the actuation circuit 21 of the actuator 20. The actuation circuit 21 of the actuator 20 comprises a channel emerging into the lower chamber 15 when the impact piston 16 rises. The lower chamber 15 being connected with the High-Pressure circuit 17 of the hydraulic circuit, the actuation circuit 21 is thus connected to the High-Pressure circuit 17, which results in the operation of the actuator 20 in such a way as to connect the upper chamber 14 with the High-Pressure circuit 17 of the hydraulic circuit. When the impact piston 16 descends, the actuating chamber 28 connects the actuation circuit 21 with the Low-Pressure circuit 18. The actuation circuit 21 is thus connected to the Low-Pressure circuit 18, which causes the slide-valve of the actuator 20 to move in such a way as to connect the upper chamber 14 with the Low-Pressure circuit 18. The operation of the actuator 20 is performed hydraulically based upon the position of the impact piston 16.

However, when the pressure of the High-Pressure circuit 17 exceeds a threshold value, for example during an incorrect manipulation by an operator acting on the carrier machine 11, the speed of the impact piston 16 increases. The operation of the actuator 20 being performed based upon the position of the impact piston 16, the duration of the control cycles of the actuator 20 also decreases when the speed of the impact piston 16 increases, causing the speed of the impact piston 16 to run away. Furthermore, the travel of the impact piston 16 also increases in the compression chamber 29. Thus, an excess flow rate of the High-Pressure circuit 17 may cause an overspeed of the impact piston 16 with respect to an acceptable speed limit for the fatigue behavior and wear of the device 10*a*. Furthermore, damage may also appear due to this overspeed.

To resolve this problem, the first embodiment, illustrated in FIG. 3, proposes to arrange a groove 23 on the impact piston 16 in such a way as to cooperate with a regulating portion 22 arranged in the body of the power cell 12 *a*.

The regulating portion 22 is connected on the one hand to the High-Pressure circuit 17, and on the other hand to the Low-Pressure circuit 18. The section of the impact piston 16 is adapted to the inner section of the power cell 12*a* such that the regulating portion 22 is closed off by the impact piston 16 when the impact piston 16 is movable within a predetermined movement zone.

The predetermined movement zone corresponds to a regulated use of the device 10*a* wherein the flow rate of the High-Pressure circuit 17 is below a threshold value. Preferably, the predetermined movement zone also corresponds to an operation of the device wherein the device cooperates with a tool. Thus, the invention does not relate to devices aiming to prevent an absence of a tool.

The association of the groove 23 and the regulating portion 22 forms depressurization means making it possible to place the High-Pressure circuit 17 in hydraulic communication with the Low-Pressure circuit 18 based upon the position of the impact piston 16 in the power cell 12*a*.

Preferably, the impact piston 16 has a shape of revolution cooperating with annular chambers 14, 15. The impact piston 16 can comprise sealing gaskets arranged on either side of the groove 23.

Figure 4:
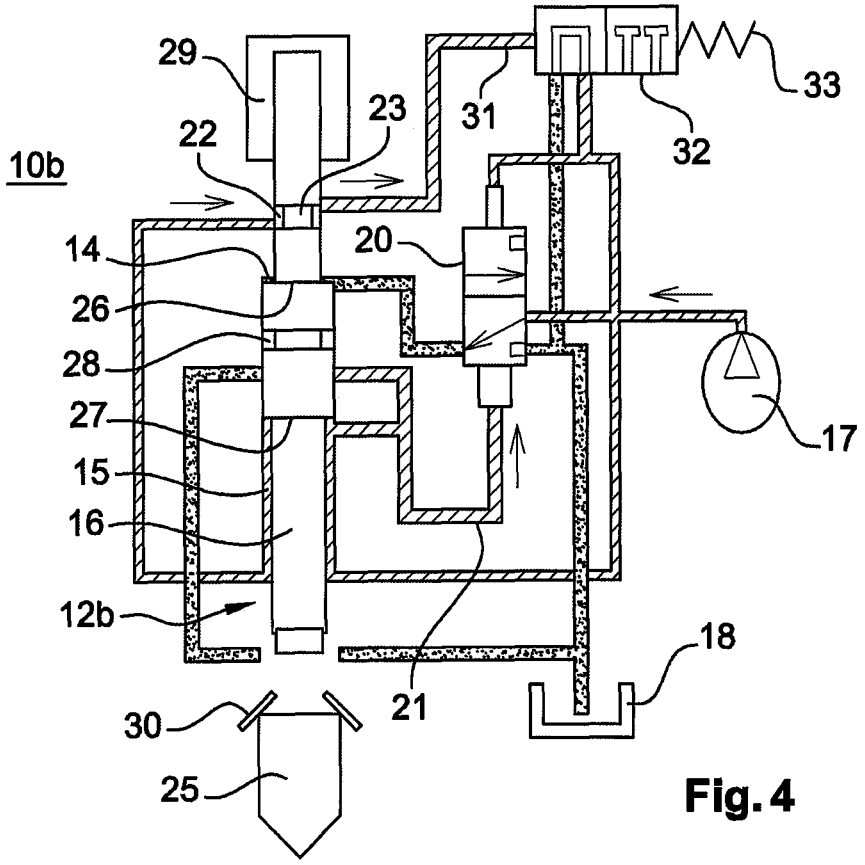

FIG. 4 illustrates a second embodiment of a power cell 12*b* of a device 10*b* wherein the regulating portion 22 is connected to the High-Pressure circuit 17 such as to actuate a depressurization valve 32. The depressurization valve 32 is movable between two positions: a maintenance position, wherein the High-Pressure circuit 17 is disconnected from the Low-Pressure circuit 18, and a depressurization position, wherein the High-Pressure circuit 17 is connected to the Low-Pressure circuit 18. The position of said depressurization valve 32 is controlled by a hydraulic circuit 31 connected to the regulating portion 22. A return spring 33 is arranged in order to place the depressurization valve 32 in the maintenance position when the High-Pressure circuit 17 is not connected to the hydraulic circuit 31.

In the same manner as for the first embodiment of FIG. 3, the regulating portion 22 is closed off by the impact piston 16 when the impact piston 16 is movable in the predetermined movement zone. Thus, the hydraulic circuit 31 is not connected to the High-Pressure circuit 17 and the return spring 33 places the depressurization valve 32 in the maintenance position. When the impact piston 16 leaves the predetermined movement zone, the hydraulic circuit 31 is connected to the High-Pressure circuit 17 and actuates the depressurization valve 32 in the depressurization position by overcoming the return force of the return spring 33.

These two embodiments, illustrated in FIGS. 3 and 4, make it possible to transmit part of the fluid from the High-Pressure circuit 17 to the Low-Pressure circuit 18. The quantity of fluid that is thus transmitted depends upon the period of communication between the High-Pressure 17 and Low-Pressure 18 circuits. To calibrate the quantity of fluid transmitted upon each cycle wherein the impact piston 16 leaves the predetermined movement zone, it is possible to extend the travel of the impact piston 16, for example by several millimeters.

Figure 5:
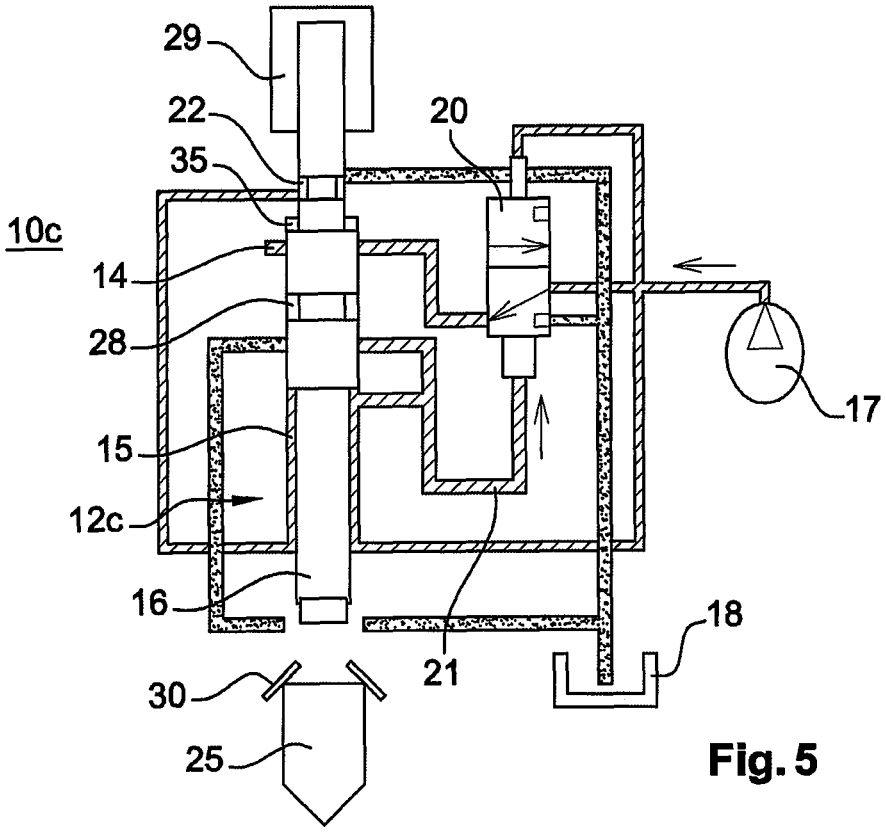

To the same end, FIG. 5 illustrates a third embodiment of a power cell 12*c* and a device 10*c* wherein the power cell 12*c* comprises braking means 35 of the impact piston 16. The braking means 35 are arranged above the upper chamber 14 and make it possible to slow the travel of the impact piston 16 when the impact piston 16 leaves the predetermined movement zone. The transmission duration of the fluid between the High-Pressure 17 and Low-Pressure 18 circuits is then increased. Preferably, the braking means 35 are made by a flange arranged on the impact piston 16 and intended to penetrate a chamber of the power cell 12*c* filled with compressible fluid. When the impact piston 16 leaves the predetermined movement zone, a surface of the flange cooperates with the compressible fluid of the chamber of the power cell 12*c*, which causes a slowing of the impact piston 16.

Figure 6:
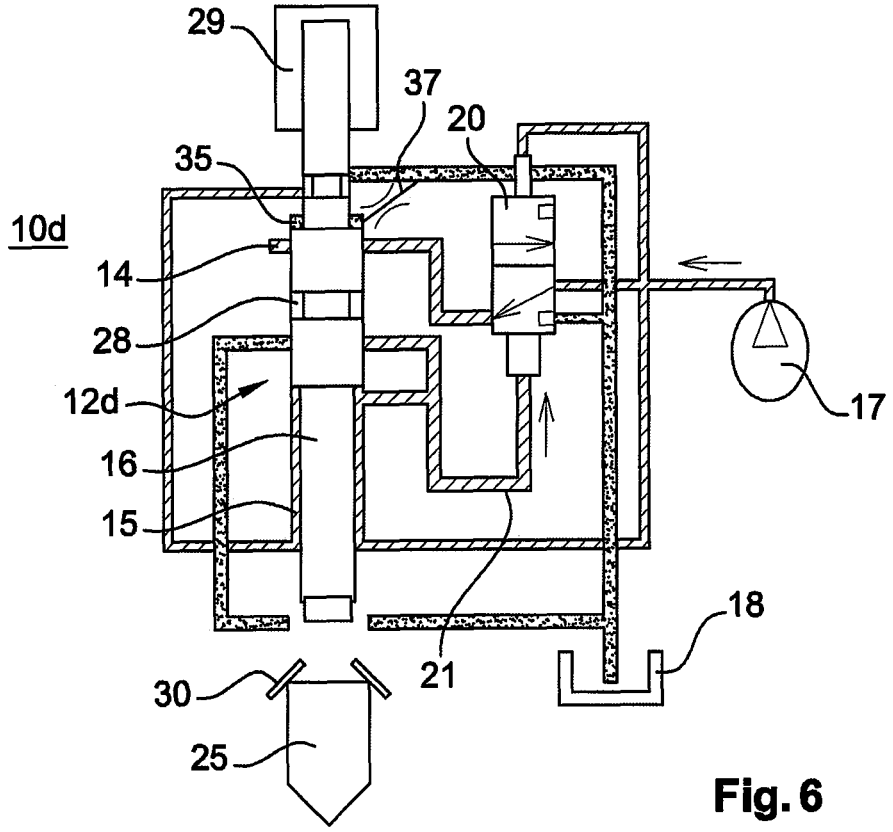

FIG. 6 illustrates a fourth embodiment of a power cell 12*d* of a device 10*d* wherein the braking means 35 are connected to the Low-Pressure circuit 18 via a sprinkler 37.

This embodiment allows the operating cycle to be completely stopped when the impact piston 16 leaves the predetermined movement zone for the time that the sprinkler empties the fluid contained in the braking means 35. To that end, the surface of the flange of the impact piston 16 and the surface of the power cell 12*d* filled with compressible fluid are calculated so that the resultant of the forces applied to the impact piston 16 based upon the pressures maintains the impact piston 16 with a total discharge of the pressurized compressible fluid toward the Low-Pressure circuit 18.

Figure 7:
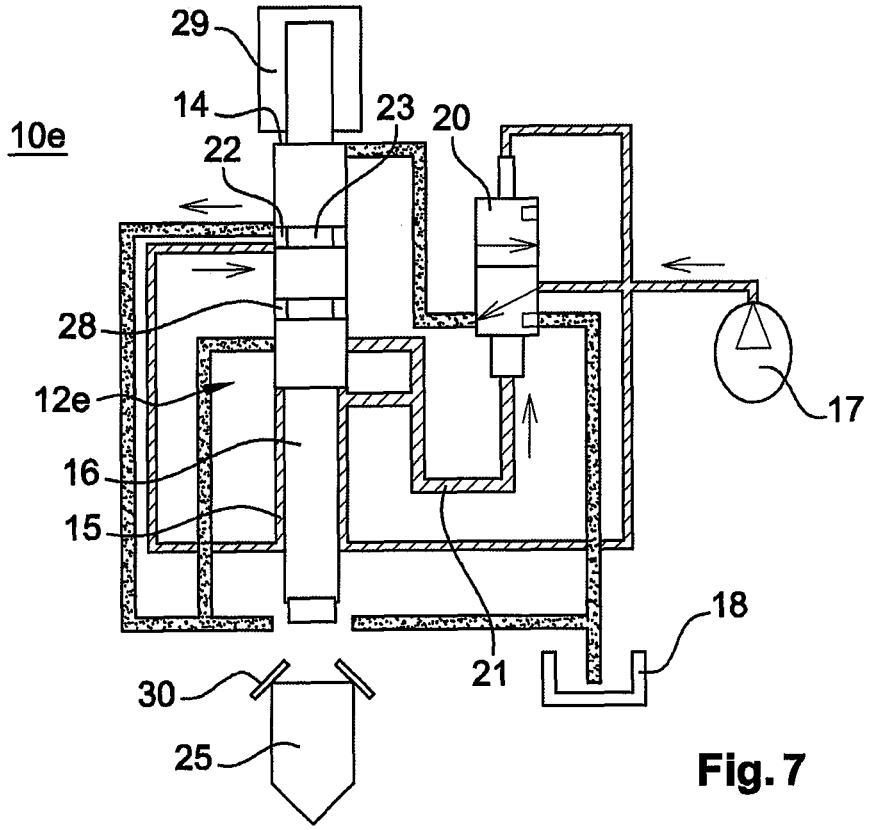
Figure 8:
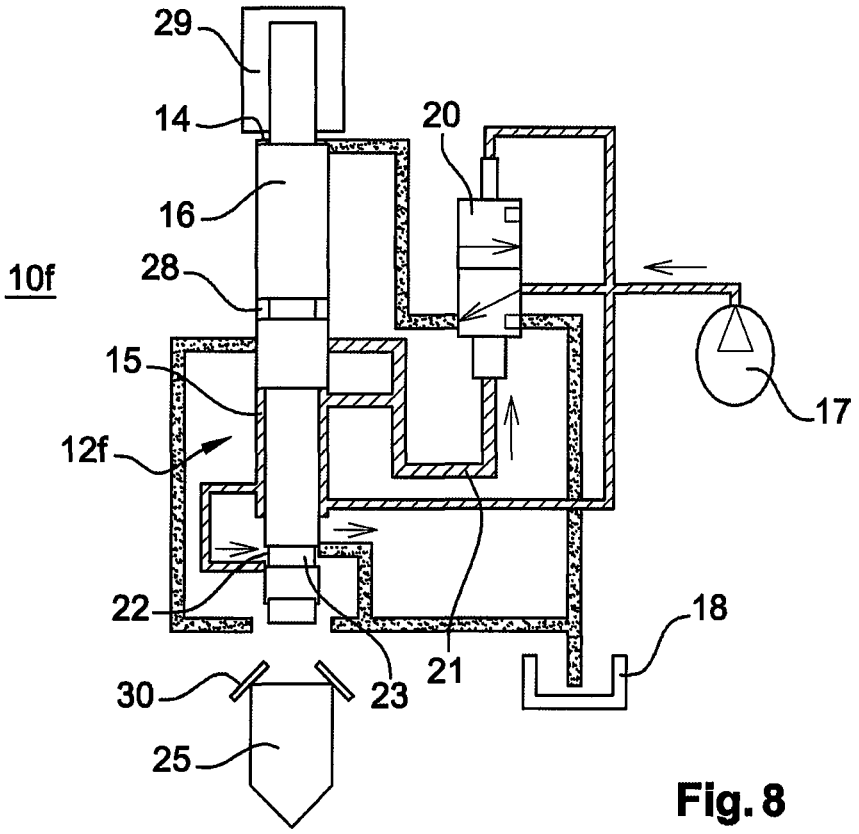

The four embodiments of FIGS. 3 to 6 illustrate a regulating portion 22 positioned above the upper actuating chamber 14. Alternatively, FIG. 7 illustrates a fifth embodiment of a power cell 12*e* of a device 10*e* wherein the regulating portion 22 is positioned between the two actuating chambers 14, 15. FIG. 8 illustrates a sixth embodiment of a power cell 12*f* of a device 10*f* wherein the regulating portion 22 is positioned below the lower actuating chamber 15.

Figure 9:
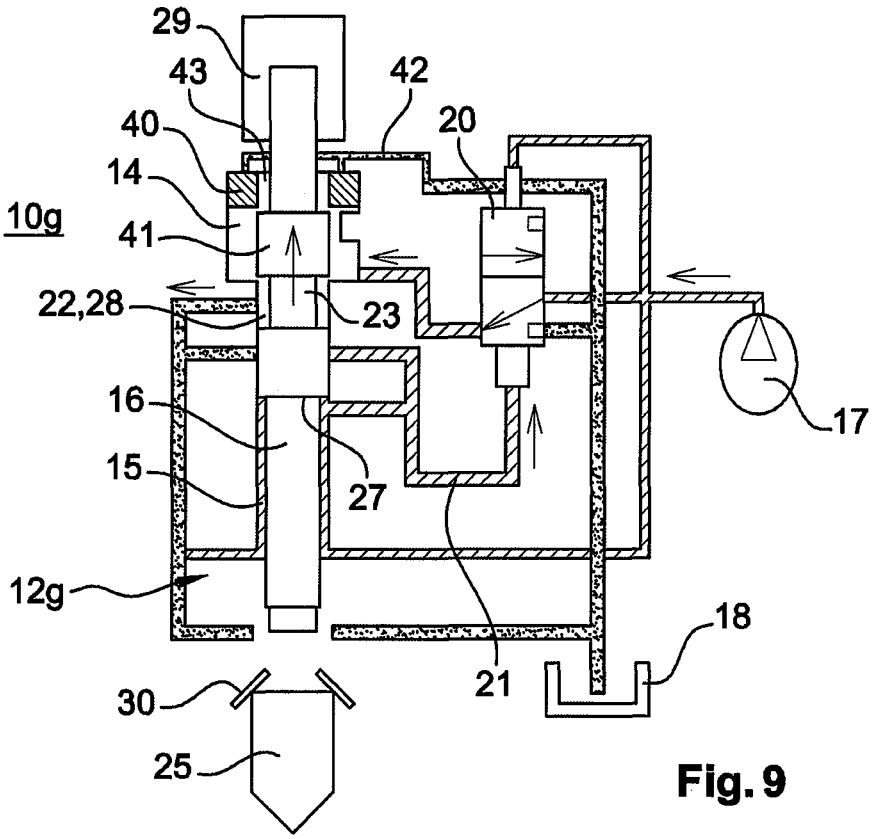
Figure 10:
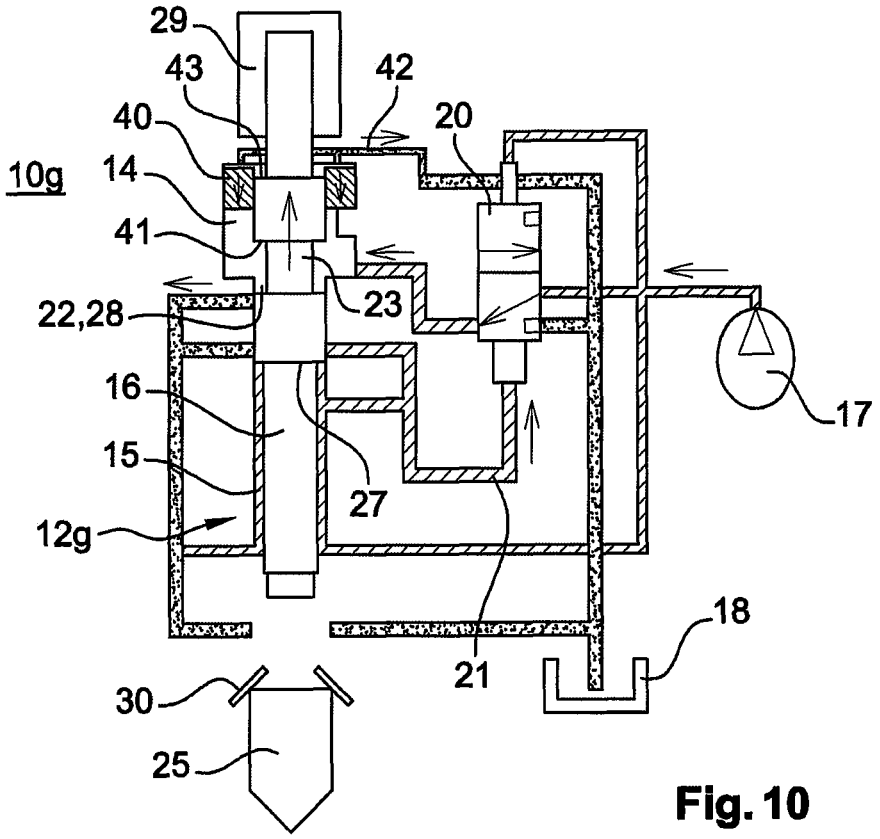
Figure 11:
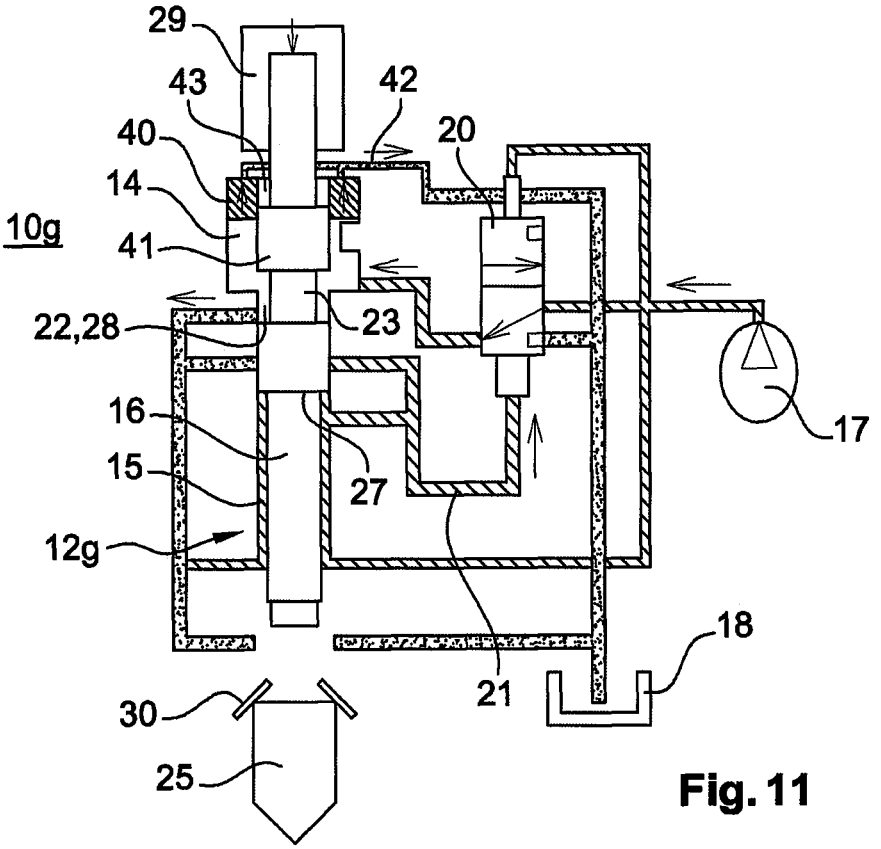

FIGS. 9 to 11 illustrate a seventh embodiment of a power cell 12*g* of a device 10*g* wherein the regulating portion 22 is in hydraulic communication with the upper actuating chamber 14. The regulating portion 22 is arranged immediately below the upper chamber 14 and comprises a diameter smaller than the diameter of the upper chamber 14. The impact piston 16 has a groove 22 arranged consecutively with an annular protuberance 41 such that the annular protuberance 41 can cooperate with the regulating portion 22 and hydraulically isolate the regulating portion 22 from the upper chamber 14.

Thus, when the impact piston 16 is movable in the predetermined movement zone, as illustrated in FIG. 10, the annular protuberance 41 blocks any hydraulic communication between the upper chamber 14 and the regulating portion 22.

The regulating portion 22 is also connected with the Low-Pressure circuit 18. When the impact piston 16 leaves the predetermined movement zone, as illustrated in FIG. 9, the annular protuberance 41 of the impact piston 16 is positioned in the upper chamber 14 and the groove 23 of the impact piston 16 makes it possible to establish a hydraulic communication between the upper chamber 14 and the regulating portion 22. The fluid from the High-Pressure circuit 17 contained in the upper chamber 14 is then transmitted to the Low-Pressure circuit 18 via the regulating portion 22.

The braking system of the impact piston 16 differs from the previous embodiments insofar as it comprises a movable ring 40 arranged in the upper chamber 14. The ring 40 is arranged in front of a channel 42 connecting the upper chamber 14 with the Low-Pressure circuit 18. Thus, when the impact piston 16 is movable in the predetermined movement zone, the pressure from the High-Pressure circuit contained in the upper chamber 14 presses the ring 40 against the channel 42, which blocks the hydraulic communication between the High-Pressure circuit 17 and the Low-Pressure circuit 18 by the channel 42.

As illustrated in FIGS. 10 and 11, the annular protuberance 41 of the impact piston 16 is configured in order to cooperate with the ring 40 when the impact piston 16 leaves the predetermined movement zone. When the impact piston 16 rises in the upper chamber 14, the annular protuberance 41 penetrates the ring 40, an emptying compartment 43 is formed. This emptying compartment 43 can then be hydraulically isolated from the upper chamber 14, and therefore from the High-Pressure circuit 17.

The fluid in the High-Pressure circuit 17 remaining in this emptying compartment 43 then causes the ring 40 to move downward around the impact piston 16, which opens the channel 42 connecting the emptying compartment 43 with the Low-Pressure circuit 18. The fluid from the emptying compartment 43 is then transmitted toward the Low-Pressure circuit 18 and optionally the chamber 14; during this process, the impact piston 16 is kept in the ring 40.

When a sufficient quantity of fluid has been transmitted between the emptying compartment 43 and the Low-Pressure circuit 18 and optionally the chamber 14, the impact piston 16 reverses the movement thereof and begins the descent thereof; the ring 40 is redirected upward to close off the channel 42 once again. The impact piston 16 slowly frees itself from the ring 40 and the impact piston 16 can resume a normal activity. During this braking process, a significant quantity of fluid can thus be transmitted between the High-Pressure circuit 17 and the Low-Pressure circuit 18 via the regulating portion 22.

This embodiment makes it possible to manage the opening time of the hydraulic communication more easily between the High-Pressure circuit 17 and the Low-Pressure circuit 18 with respect to the uncertainties relating to the machining allowances. Alternatively, the braking system and/or the depressurization system can be installed at the lower chamber 15.

Alternatively, the evacuation of the pressure from the emptying compartment 43 can be performed by means of a peripheral channel arranged around the ring 40. In this embodiment, the annular protuberance 41 penetrates the ring 40 when the impact piston 16 leaves the predetermined movement zone such as to create an emptying compartment 43 wherein the pressure is sufficient to move the ring 40 around the annular protuberance 41. The pressure of the emptying compartment 43 is discharged gradually into the actuating chamber through the peripheral channel such as to allow for the removal of the annular protuberance 41 and the movement of the ring 40. During this braking process, a significant quantity of fluid can thus be transmitted between the High-Pressure circuit 17 and the Low-Pressure circuit 18 via the regulating portion 22.

Figure 12:
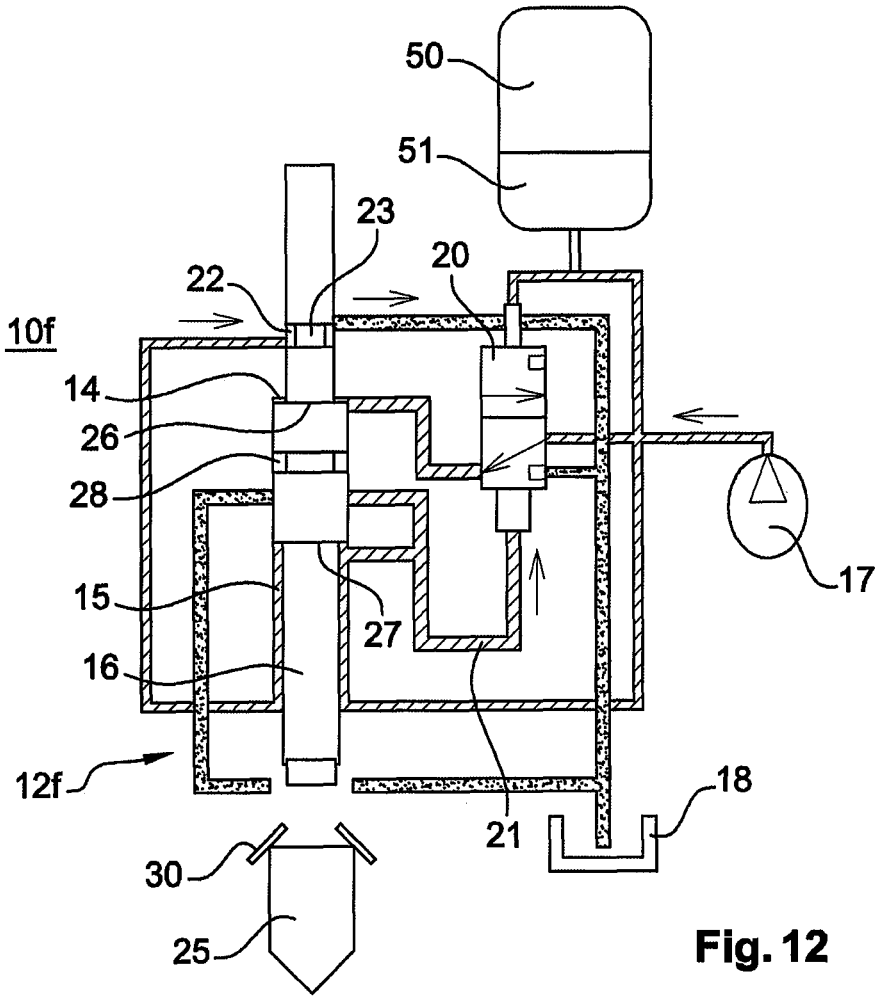
FIG. 12: a schematic representation in cross-section of a rock breaking device according to an eighth embodiment of the invention.

FIG. 12 illustrates an eighth embodiment of a power cell 12*f* of a device 10*f* similar to that of FIG. 3, but wherein there is no compression chamber above the impact piston 16. The upper end of the impact piston 16 is not pressurized and can be connected to the open air. The differences in sections between the upper 14 and lower 15 chambers are more pronounced than for the embodiment of FIG. 3.

Thus, the acceleration of the impact piston 16 is created by the high pressure applied on the difference of the sections between the upper 14 and lower 15 chambers. A nitrogen accumulator comprises two chambers 50, 51 connected by means of a deformable membrane. The lower chamber 51 of the nitrogen accumulator is connected to the high-pressure circuit, while the upper chamber 50 comprises pressurized nitrogen. The nitrogen accumulator makes it possible to store pressurized fluid when the impact piston 16 rises and to retrieve this fluid during the accelerated descent.

The invention thus makes it possible to use the increase in the normal travel of the impact piston 16 when there are excess flow rates in order to control a transfer of flow rate from the High-Pressure circuit 17 to the Low-Pressure circuit 18.

The invention claimed is:

1. A rock breaking device, comprising:

a power cell having at least one actuating chamber, an impact piston translatable in the power cell, a compression chamber distant from the at least one actuating chamber and containing a compressible gas, the compression chamber being configured so that when the device is actuated, applied pressure of a hydraulic fluid in the at least one actuating chamber moves the impact piston inside the compression chamber, the impact piston compressing the gas in the compression chamber, and a hydraulic circuit comprising:

a hydraulic supply source having a High-Pressure circuit and a Low-Pressure circuit, and an actuator configured to connect the High-Pressure circuit or the Low-Pressure circuit to the actuating chamber such as to translate the piston in the power cell in a normal movement zone wherein the boundaries are variable depending upon the pressure difference between the High-Pressure circuit and the Low-Pressure circuit, wherein the power cell comprises depressurization means configured to command a placement in hydraulic communication of the High-Pressure circuit with the Low-Pressure circuit when the impact piston leaves a predetermined movement zone in said compression chamber.

2. The device according to claim 1, wherein the depressurization means comprise:

a groove arranged on the impact piston, and a regulating portion connected to the High-Pressure circuit and to the Low-Pressure circuit, the regulating portion being closed off by the impact piston when the impact piston is movable in the predetermined movement zone, said groove being intended to penetrate the regulating portion when the impact piston leaves the predetermined movement zone such as to place the High-Pressure circuit in hydraulic communication with the Low-Pressure circuit through the regulating portion.

3. The device according to claim 2, wherein the device comprises an upper actuating chamber and a lower actuating chamber, and the regulating portion is positioned above the upper actuating chamber.

4. The device according to claim 2, wherein the device comprises an upper actuating chamber and a lower actuating chamber, and the regulating portion is positioned below the upper actuating chamber.

5. The device according to claim 2, wherein the device comprises an upper actuating chamber and a lower actuating chamber, and the regulating portion is positioned between the two actuating chambers.

6. The device according to claim 1, wherein the depressurization means comprise:

a depressurization valve connected to the High-Pressure circuit and to the Low-Pressure circuit, the depressurization valve being able to selectively and alternatively adopt a maintenance position wherein the High-Pressure circuit is disconnected from the Low-Pressure circuit, and a depressurization position wherein the High-Pressure circuit is connected to the Low-Pressure circuit, positions of said depressurization valve being commanded by a hydraulic circuit, a regulating portion connected to the High-Pressure circuit and to the hydraulic circuit, the regulating portion being closed off by the impact piston when the impact piston is movable in the predetermined movement zone such that the hydraulic circuit actuates the depressurization valve in the maintenance position, and a groove arranged on the impact piston, said groove being intended to penetrate the regulating portion when the impact piston leaves the predetermined movement zone such that the hydraulic circuit actuates the depressurization valve in the depressurization position.

7. The device according to claim 1, wherein the depressurization means comprise:

a groove and an annular protuberance that are arranged consecutively on the impact piston, and a regulating portion connected to the Low-Pressure circuit and to the actuating chamber, the annular protuberance closing off a hydraulic communication channel between the regulating portion and the actuating chamber when the impact piston is movable in the predetermined movement zone, said groove being intended to penetrate the actuating chamber when the impact piston leaves the predetermined movement zone such as to place the actuating chamber in hydraulic communication with the regulating portion through a channel passing through the groove.

8. The device according to claim 1, wherein the device comprises hydraulic braking means for the impact piston configured to slow travel of the impact piston when the impact piston leaves the predetermined movement zone.

9. The device according to claim 8, wherein the hydraulic braking means comprise a spray nozzle connected to the Low-Pressure circuit and configured to extract part of hydraulic fluid contained in the hydraulic braking means.

10. The device according to claim 8, wherein the hydraulic braking means comprise:

a channel connecting the actuating chamber with the Low-Pressure circuit, an annular protuberance arranged on the impact piston, and a movable ring in the actuating chamber, the ring being positioned to close off the channel when the impact piston is movable in the predetermined movement zone, the annular protuberance being intended to penetrate the ring when the impact piston leaves the predetermined movement zone such as to create an emptying compartment whose pressure is sufficient to move the ring and establish hydraulic communication between the emptying compartment and the channel, the annular protuberance being removed from the ring and the ring being repositioned to close off the channel when a pressure difference between the actuating chamber and the emptying compartment is above a threshold value.

11. The device according to claim 8, wherein the hydraulic braking means comprise:

an annular protuberance arranged on the impact piston, and a movable ring in the actuating chamber, the annular protuberance being intended to penetrate the ring when the impact piston leaves the predetermined movement zone such as to create an emptying compartment whose pressure is sufficient to move the ring around the annular protuberance, hydraulic fluid contained in the emptying compartment being able to reach the actuating chamber by means of a peripheral channel arranged around the ring when the ring is moved on the annular protuberance such as to reduce the pressure difference between the emptying compartment and the actuating chamber and remove the annular protuberance from the ring.

* * * * *